United States Patent [19]

Larsen et al.

[11] 4,117,932

[45] Oct. 3, 1978

[54] PLASTIC PACKAGING PRODUCT FOR SEPARATION OF COMPONENTS

[75] Inventors: Ronald L. Larsen, Minneapolis, Minn.; Clifford W. Berry, Marlton, N.J.

[73] Assignee: Conwed Corporation, St. Paul, Minn.

[21] Appl. No.: 862,181

[22] Filed: Dec. 19, 1977

Related U.S. Application Data

[63] Continuation of Ser. No. 748,635, Dec. 8, 1976, abandoned.

[51] Int. Cl.[2] ..... B65D 85/42

[52] U.S. Cl. ..... 206/419; 206/443; 206/501; 206/821; 211/60 R

[58] Field of Search ..... 206/418, 419, 420, 421, 206/422, 386, 821, 501, 443; 211/124, 60 R, 181, 40, 41, 42; 214/10.5 R, 10.5 S; 248/175, 302; 220/19; 217/33

[56] References Cited

U.S. PATENT DOCUMENTS

| | | | |
|---|---|---|---|
| 2,238,451 | 4/1941 | Roth | 211/40 |
| 2,980,244 | 4/1961 | Gendre | 206/418 |
| 2,984,345 | 5/1961 | Emery | 206/419 |
| 3,175,694 | 3/1965 | Reibold et al. | 211/60 R |
| 3,587,865 | 6/1971 | Phillips | 211/181 |
| 3,739,918 | 6/1973 | Kreitzburg | 211/181 |
| 3,777,905 | 12/1973 | Morris | 206/821 |
| 3,900,116 | 8/1975 | Gehri | 214/10.5 R |

FOREIGN PATENT DOCUMENTS

| | | | |
|---|---|---|---|
| 1,418,721 | 10/1965 | France | 26/386 |
| 734,977 | 8/1955 | United Kingdom | 211/40 |
| 908,071 | 10/1962 | United Kingdom | 206/386 |

*Primary Examiner*—William Price
*Assistant Examiner*—Joseph M. Moy
*Attorney, Agent, or Firm*—Eyre, Mann, Lucas & Just

[57] ABSTRACT

A plastic packaging product is disclosed. In its final form it can be used in packaging to locate, separate and suspend items to be packaged. The packaging product comprises a plurality of extruded members in one direction linked with a plurality of extruded members in a transverse direction.

6 Claims, 12 Drawing Figures

FIG. 5
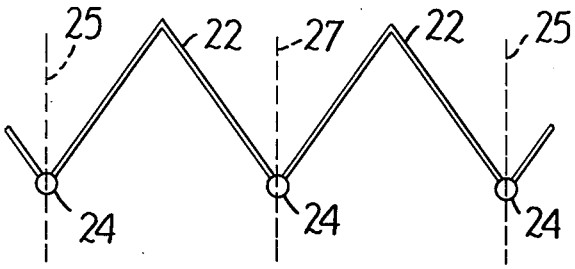
FIG. 6
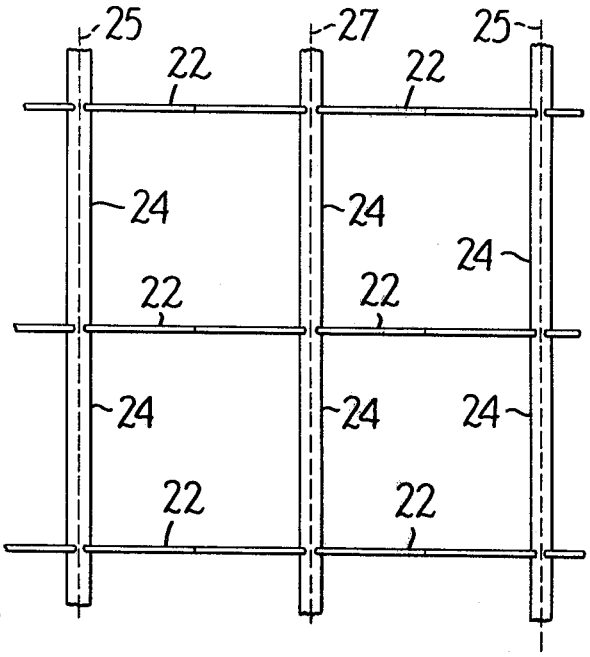
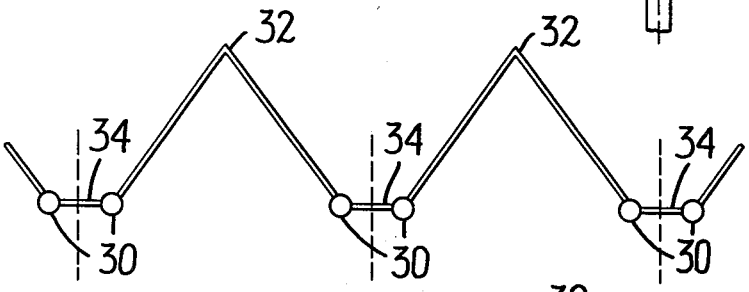
FIG. 7
FIG. 8
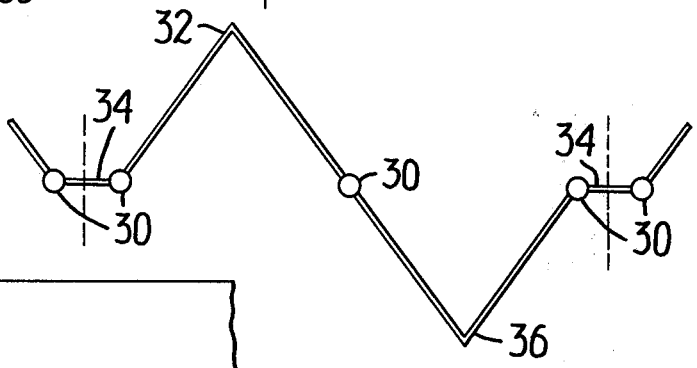
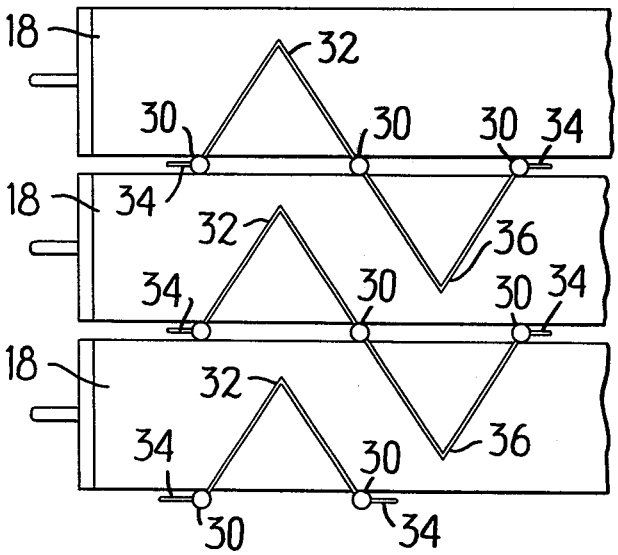
FIG. 9

PLASTIC PACKAGING PRODUCT FOR SEPARATION OF COMPONENTS

This is a continuation of application Ser. No. 748,635, Filed Dec. 8, 1975 now abandoned.

BACKGROUND OF INVENTION

Field of Invention

The present invention relates to a new and useful packaging product for locating, separating and suspending items to be packaged. The packaging product is especially useful for packing fragile goods such as fluorescent lamps, medical thermometers, glass pipe, and the like.

SUMMARY OF THE INVENTION

The packaging product of the present invention comprises a plurality of first spaced parallel members in a first plane joined together by an integrally formed plurality of second spaced linking members which extend into a plane which is normal to the first plane. The first members and second linking members are preferably of different dimensions. Articles to be packaged are placed transversely on the first members and between adjacent second linking members. The linking members separate adjacent items while the first members separate superposed items or surfaces or objects. Alternately, articles to be packaged are placed longitudinally along the first members which both support and separate superposed and adjacent articles.

BRIEF DESCRIPTION OF THE DRAWINGS

These and other features of the present invention may be more fully understood with reference to the drawings in which like numbers refer to like parts and in which:

FIGS. 5, 7 and 8 are cross sections of alternative embodiments of the packaging product of the present invention;

FIG. 6 is a top view of the packaging products of FIG. 5;

FIG. 9 is a view of the packaging product of FIGS. 7 and 8 also showing a side view of a stack of separated fluorescent lamps;

DESCRIPTION OF THE PREFERRED EMBODIMENTS

Figure 1:
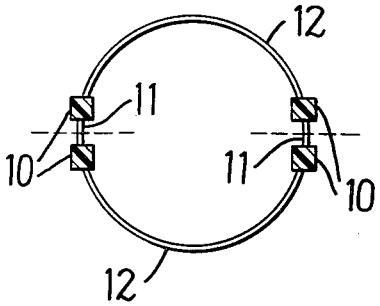
FIG. 1 is a cross section of an intermediate extrusion prior to cutting to make a packaging product of the present invention.

The packaging product according to the present invention is commonly made from plastic net and can be made, for example, according to the teachings of any one of the following U.S. patents, among others: Lemelson, U.S. Pat. No. Re. 28,600, Galt, U.S. Pat. No. 3,384,692, Hureau. U.S. Pat. No. 3,252,181, Martin, U.S. Pat. No. 3,112,526, Gutierrez, U.S. Pat. No. 3,089,804, Tittman, U.S. Pat. No. 3,178,328, Nalle, U.S. Pat. Nos. 3,019,147 and 3,118,180, Mercer, U.S. Pat. No. 2,919,467 or Gaffney, U.S. Pat. No. 3,700,521. However, it is not necessary that the material be extruded.

Where according to these patents a tubular product is made, the packaging product of the present invention can be made as shown in FIG. 1 by cutting the tubes to length through longitudinal member 10 and by cutting the transverse linking member 11.

Figure 2:
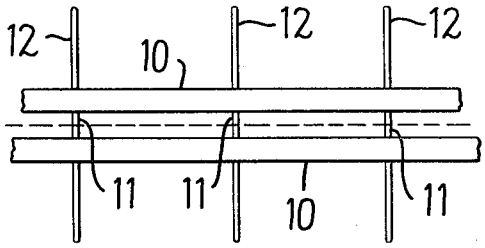
FIG. 2 is a side view of the intermediate extrusion of FIG. 1.
Figure 3:
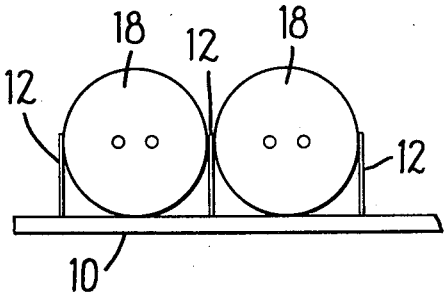
FIG. 3 is a side view of the finished packaging product made by cutting the intermediate extrusion of FIGS. 1 and 2 along the dashed line and shown separating fluorescent lamps.
Figure 4A:
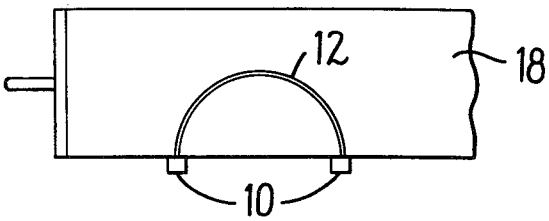
FIG. 4 (*a*), (*b*), and (*c*), (*d*), are views of the packaging products of FIGS. 1, and 5 respectively with a fluorescent lamp.
Figure 4B:
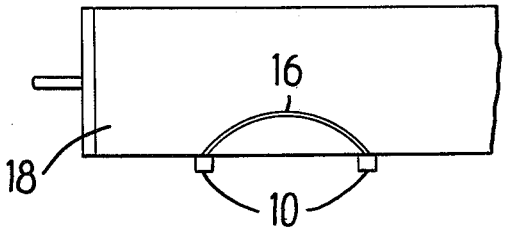
Figure 4C:
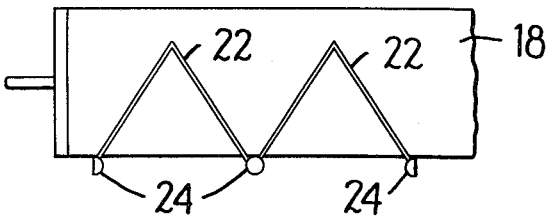
Figure 4D:
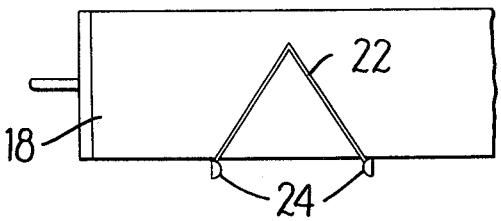

In FIGS. 1 and 2 there is shown the intermediate product of the preferred embodiment of the packaging product made according to the present invention. The packaging product comprises a first set of parallel members 10, joined together by intergral linking members 12 and can be made in the form of a tube as shown in FIGS. 1 and 2. Thereafter, members 10 are separated by cutting along the dashed line. The separated halves are shown in use in FIGS. 3 and 4(*a*). The product shown in FIGS. 1–2 has been extruded; the machine direction or longitudinal members are referenced by 10 while the transverse members are referenced by 12. Although a tubular product with only four longitudinal members 10 is shown, a tubular product may be extruded having more than four (not shown). Where the net is extruded with, for example, eight longitudinal members, the adjacent members are cut to form a packaging product in which the transverse members form quarter-circles, as referenced by 16 in FIG. 4(*b*). The spacing of the transverse members may be chosen so that a particular product to be packaged fits therebetween, as shown in FIGS. 3 and 4(*a*), (*b*), wherein fluorescent lamps 18 are positioned in the spaces between the transverse members 12, which separate juxtaposed lamps. The longitudinal members 10 separate the lamps from each other and/or from adjacent surfaces or objects. The members 10 and 12 may be rigid, semi-rigid, or flexible. Where the spacing between transverse strands is preselected to separate predesignated products, or where rigidity is desired for other reasons, the transverse strands may be rigid. Otherwise, it is preferred that the transverse strands be somewhat flexible, that is capable of being flexed to accommodate products of different dimensions. It is preferred that the longitudinal strands be more rigid.

As shown in the drawings and especially in FIG. 3, strands 10 lie in one plane (the horizontal) while strands 12 extend into a second plane (the vertical) which is normal to the first plane. It is desirable that the second set of strands extend at least ¼ inch into the second said plane, preferred that they extend at least ⅜ inch into the second said plane and most preferred that they extend at least ½ inch into the second said plane. It must be understood that while the second plane is normal to the first plane this in no way dictates the shape, angularity to the longitudinal, or other dimension of the strands 12 but only indicates an overall three dimensional product. It will also be understood that there may be three or more longitudinal members two of which are in a different plane from any other two. In accordance with the present invention it is sufficient for members 12 to extend into the second plane between any two adjacent longitudinal members and it is not necessary that this relationship exist between all longitudinal strands.

When a tubular net is cut into a semi- or quarter-circle as shown in FIGS. 4(*a*) and 4(*b*), only one or two rows of a packaging product will be obtained as opposed to multiple rows when using a corrugated net form as shown in FIGS. 5–9. The transverse members 22, 26 may be of sawtooth shape as shown in FIG. 5, or of arcuate or other shape (not shown). The corrugated net may be cut in the longitudinal direction of member 24 at the dashed lines 25, 27, 25, as shown best in FIG. 6. When cut in this manner, a single row is provided for packaging products as shown in FIG. 4(*d*) and referenced by 24, 22, 24. Alternatively, two rows may be provided as shown in FIG. 4(*c*) by cutting of the members only on dashed lines 25, leaving the product referenced by 24, 22, 24 (FIG. 4(*c*)). Similarly, more than two rows may be obtained is desired by simply adjusting the point of cut.

The spacing between the longitudinal members 24 may be equal as shown in FIGS. 5 and 6 or may be unequal as shown in FIGS. 7 and 8. The corrugated net shown in FIG. 7 comprises sawtooth transverse members 32 and planar transverse members 34. The planar members 34 may be cut to form a single row packaging product (see FIG. 9) or may be cut to form multiple row products as discussed above.

In FIG. 8, another embodiment of the invention is shown which is especially suited for packaging products in layers or stacks. Corrugated transverse members 32 and 36 are extruded in opposed relationship. Adjacent each pair of corrugated transverse members are planar transverse members 34. The corrugated net is suitably cut in the longitudinal direction through each transverse member 34. Products may then be stacked as shown in FIG. 9. The lowermost and uppermost layers employ only a singly corrugated product, as for example, the one shown in FIG. 7. The intermediate layers are separated by the doubly corrugated product of FIG. 8.

The products of the present invention, which are preferably made from extruded thermoplastics, have considerable advantage over prior art products. Because of the ease of changing dies in the cited patents, the longitudinal direction members can be spaced at any desired interval to accommodate the particular product to be packaged. Similarly, the linking or transverse members can be spaced at any desired interval to supply the necessary support to the longitudinal members without undue cluttering of the package or needless expense in excess material.

While the longitudinal members have been shown as square or round, it will be appreciated that they can be any shape which will fulfill the need of the products to be packaged such as oval, diamond, etc. Similarly, the transverse linking members need not be of any particular configuration in cross section.

The material of the packaging product may be flexible, rigid or semi-rigid depending upon the particular application and as described hereinbefore; and the longitudinal strands and linking members may be of different materials if desired, as for example when the material is made according to U.S. Pat. No. 3,700,521. Where the material is made of flexible thermoplastic, it will be appreciated that it can be bent to conform to any particular shape desired. It will further be appreciated than in certain applications it would be of advantage to make the material of rigid thermoplastic especially from a tube as shown in FIG. 1 so that packaging product of arcuate cross section is obtained.

The transverse members are preferably but need not necessarily be of smaller cross section than the longitudinal members, the relative cross sections varying in accordance with intended end use.

The packaging product need not be entirely of the same material, and materials such as polyethylene, polyamide, polypropylene and elastomeric, foamed and expanded materials may be used for individual members. The material of which the packaging product is made need not be extruded.

Also all the longitudinal members or all the transverse members or both need not be of uniform size. For example, the size of the longitudinal or the transverse members, or both, may alternate between two sizes for adjacent members. The smaller members may be flexed aside during use and act as additional separating material between rows or layers. Supplementary members may also be added. For example, smaller longitudinal members may be added parallel to the main longitudinal members to reinforce the transverse members. The supplementary members may be cut prior to use in appropriate applications.

Other changes and embodiments will be readily seen by those skilled in the art and the claims are, therefore, intended to cover all changes in embodiment of the preferred forms of the invention herein described which do not depart from the spirit and scope of the invention.

What is claimed is:

1. An extended plastic packaging product for separation and cushioning of a plurality of components in horizontal and vertical directions, said packaging product comprising:

(a) a plurality of spaced, parallel longitudinal strands lying in a first plane;

(b) at least three linking transverse strands spaced along the length of said longitudinal strands and connecting said longitudinal strands, said linking strands having a portion between said longitudinal strands extending at least ¼ inch into a second plane;

(c) said longitudinal and linking strands being extruded as an integral plastic structure;

(d) said linking strands being or smaller cross-sectional dimension than said longitudinal strands and being flexible and said longitudinal strands being more rigid than said linking strands;

(e) the adjacent linking strands being spaced to accommodate only one of said components and separate it from adjacent components lying in the same horizontal plane; and (f) the longitudinal strands being arranged to support one layer of said components in a first horizontal plane and to separate said first layer from an adjacent layer of said components in a parallel horizontal plane.

2. The packaging product of claim 1 wherein the transverse linking strands extend at least ¼ inch into said second plane.

3. The packaging product of claim 1 wherein the axes of said transverse linking strands are triangularly shaped.

4. The packaging product of claim 1, wherein the parallel longitudinal strands are essentially a portion of a circle in cross section.

5. The packaging product of claim 1, wherein there are at least three spaced parallel longitudinal strands and wherein the spaced between two adjacent parallel longitudinal strands is different from the spaces betweem two other adjacent parallel longitudinal strands.

6. The packaging product of claim 1 wherein said plurality of transverse linking members extend into at least said second plane in at least two opposed directions from the said first plane.

* * * * *

UNITED STATES PATENT AND TRADEMARK OFFICE

CERTIFICATE OF CORRECTION

PATENT NO. : 4,117,932

DATED : October 3, 1978

INVENTOR(S) : Ronald L. Larsen and Clifford W. Berry

It is certified that error appears in the above-identified patent and that said Letters Patent are hereby corrected as shown below:

Column 3, line 9, "is" should read --if--.

Column 3, line 66, "be entirely" should read --be made entirely--.

Column 4, line 63, "betweem" should read --between--.

Column 4, line 65, "members" should read --strands--.

Column 4, line 37, "or" should read --of--.

Signed and Sealed this

*Eighteenth* Day of *September 1979*

[SEAL]

*Attest:*

*Attesting Officer*

LUTRELLE F. PARKER

*Acting Commissioner of Patents and Trademarks*